US005863859A

United States Patent [19]

Uytterhoeven et al.

[11] Patent Number: 5,863,859

[45] **Date of Patent: *Jan. 26, 1999**

[54] HEAT-SENSITIVE MATERIAL SUITED FOR USE IN DIRECT THERMAL RECORDING

[75] Inventors: Herman Uytterhoeven, Bonheiden; Leo Oelbrandt, Kruibeke; Carlo Uyttendaele, Mortsel, all of Belgium

[73] Assignee: Agfa-Gevaert N.V., Mortsel, Belgium

[ * ] Notice: The term of this patent shall not extend beyond the expiration date of Pat. No. 5,527,758.

[21] Appl. No.: 689,226

[22] Filed: Aug. 6, 1996

Related U.S. Application Data

[63] Continuation of Ser. No. 438,766, May 11, 1995, abandoned.

[30] Foreign Application Priority Data

May 30, 1994 [EP] European Pat. Off. ..... 94201525

[51] Int. Cl.[6] ..... B41M 5/26; B41M 5/28; B41M 5/40

[52] U.S. Cl. ..... 503/201; 503/202; 503/210; 503/226

[58] Field of Search ..... 503/201, 210, 503/202, 209, 226; 430/338, 567, 608, 619

[56] References Cited

U.S. PATENT DOCUMENTS

| | | | |
|---|---|---|---|
| 3,080,254 | 3/1963 | Grant | 117/36.8 |
| 3,094,417 | 6/1963 | Workman | 96/28 |
| 3,241,997 | 3/1966 | Schutzner | 117/36.9 |
| 3,795,532 | 3/1974 | Newman et al. | 117/36.2 |
| 4,082,901 | 4/1978 | Laridon et al. | 428/480 |
| 4,602,265 | 7/1986 | Philpott et al. | 346/210 |
| 5,189,007 | 2/1993 | Aihara et al. | 503/207 |
| 5,278,127 | 1/1994 | Dombrowski | 503/207 |

FOREIGN PATENT DOCUMENTS

| | | | |
|---|---|---|---|
| 9303120 | 5/1994 | European Pat. Off. | 503/210 |
| 0599369 | 6/1994 | European Pat. Off. | 503/217 |

*Primary Examiner*—Bruce H. Hess
*Attorney, Agent, or Firm*—Brumbaugh, Graves, Donohue & Raymond

[57] ABSTRACT

A heat-sensitive recording material suited for use in direct thermal imaging, wherein said recording material comprises: (i) a layer (1) containing uniformly distributed in a film-forming water-insoluble resin binder a substantially light-insensitive organic metal salt, preferably a silver salt, and (ii) a layer (2) in direct contact with said layer (1) or in thermal working relationship therewith through the intermediary of a spacer layer (3), characterized in that said layer (2) contains, uniformly distributed in a film-forming water-soluble hydrophilic binder at least one organic reducing agent that is capable of diffusing out of said layer (2) into said layer (1) on heating said recording material, and is coated from an aqueous solution.

4 Claims, 3 Drawing Sheets

HEAT-SENSITIVE MATERIAL SUITED FOR USE IN DIRECT THERMAL RECORDING

This application is a continuation of application Ser. No. 08/438,766, filed on May 11, 1995, now abandoned.

FIELD OF THE INVENTION

The present invention relates to a recording material suited for use in direct thermal imaging.

BACKGROUND OF THE INVENTION

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.

2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye Layer wherefrom dyed portions or incorporated dyes are transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et al., describing the production of a silver metal image by means of a thermally induced oxidation-reduction reaction of a silver soap with a reducing agent.

As described in "Handbook of Imaging Materials", edited by Arthur S. Diamond—Diamond Research Corporation—Ventura, California, printed by Marcel Dekker, Inc. 270 Madison Avenue, New York, N.Y. 10016 (1991), p. 498–499 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place.

According to U.S. Pat. No. 3,080,254 a typical heat-sensitive copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxydihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

U.S. Pat. No. 3,241,997 concerns a heat-sensitive copying material having two separate layers located one on top of the other and carried by a supporting material, the layers having different melting points and being soluble in different solvents, the solvent of one layer being incapable of dissolving the other layer, the layers containing at least two different chemical reagents capable of reacting with each other when at least one of them is in molten form to produce colour, the colour-producing reagents being located in two different layers, whereby each layer contains at least one colour-producing reagent and whereby no one layer contains all of the colour-producing reagents, at least one of the layers and at least one of the colour-producing reagents melting at most at 150° C.

U.S. Pat No. 3,795,532 concerns sheet material containing metal soap reactants and adapted for producing a copy of an original in a heat-activated copying process when associated with a coreactant source to form a couple. The coreactant may be provided as a separate coating directly overlying and bonded to the soap layer.

A heat-sensitive recording material containing silver behenate and 4-methoxy-1-naphthol as reducing agent in adjacent water-insoluble polymeric binder layers is also described in Example 1 of U.S. Pat. No. 3,094,417.

Further, the separate application in a thermosensitive recording material of an organic silver salt and hydroxylamine type reductor in thermal working relationship in adjacent layers containing a thermoplastic water-insoluble binder such as ethyl cellulose and after-chlorinated polyvinyl chloride is described already in U.S. Pat. No. 4,082,901.

In a special embodiment of direct thermal imaging a heat-sensitive recording material is used in the form of an electrically resistive ribbon having a multilayered structure in which a carbon-loaded polycarbonate is coated with a thin aluminium film (ref. Progress in Basic Principles of Imaging Systems—Proceedings of the International Congress of Photographic Science Köln (Cologne), 1986 ed. by Friedrich Granzer and Erik Moisar—Friedr. Vieweg & Sohn—Braunschweig/Wiesbaden, FIG. 6. p. 022). Current is injected into the resistive ribbon by electrically addressing a print head electrode contacting the carbon-loaded substrate, thus resulting in highly localized heating of the ribbon beneath the energized electrode.

The fact that in using a resistive ribbon recording material heat is generated directly in the resistive ribbon and only the travelling ribbon gets hot (not the print heads) an inherent advantage in printing speed is obtained. In applying the thermal printing head technology the various elements of the thermal printing head get hot and must cool down before the head can print without cross-talk in a next position.

In another embodiment of direct thermal imaging the recording material is image-wise or pattern-wise heated by means of a modulated laser beam. For example, image-wise modulated infra-red laser light is absorbed in the recording layer in infra-red light absorbing substances converting infra-red radiation into the necessary heat for the imaging reaction.

The image-wise applied laser light has not necessarily to be infrared light since the power of a laser in the visible light range and even in the ultraviolet region can be thus high that sufficient heat is generated on absorption of the laser light in the recording material. There is no limitation on the kind of laser used which may be a gas laser, gas ion laser, e.g. argon ion laser, solid state laser, e.g. Nd:YAG laser, dye laser or semi-conductor laser.

The use of an infrared light emitting laser and a dye-donor element containing an infrared light absorbing material is described e.g. in U.S. Pat. No. 4,912,083. Suitable infra-red light absorbing dyes for laser-induced thermal dye transfer are described e.g. in U.S. Pat. No. 4,948,777, which U.S. Pat. No. documents for said dyes and lasers applied in direct thermal imaging have to be read in conjunction herewith.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

When used in thermographic recording operating with thermal printheads said recording materials will not be suited for reproducing images with fairly large number of grey levels as is required for continuous tone reproduction.

According to EP-A 622 217 relating to a method for making an image using a direct thermal imaging element, improvements in continuous tone reproduction are obtained by heating the thermal recording element by means of a thermal head having a plurality of heating elements, characterized in that the activation of the heating elements is executed line by line with a duty cycle Δ representing the ratio of activation time to total line time in such a way that the following equation is satisfied:

$$P \leq P_{max} = 3.3 W/mm^2 + (9.5\ W/mm^2 \times \Delta)$$

wherein $P_{max}$ is the maximal value over all the heating elements of the time averaged power density P (expressed in $W/mm^2$) dissipated by a heating element during a line time.

Although by controlling the heating of the heating elements of a thermal head in the way as described in said EP-A already a substantial improvement in continuous tone reproduction is obtained, from the side of the composition of the thermal recording element further improvements to lower the image gradation are still desirable.

OBJECTS AND SUMMARY OF THE INVENTION

It is an object of the present invention to provide a heat-sensitive recording material suited for use indirect thermal imaging, wherein said material is capable of yielding images with maximum density preferably higher than 2.5 and with a gradation sufficiently low for continuous tone reproduction as is needed e.g. in a portrait for an identification document and in the medical diagnostic field wherein images are produced by e.g. radiography, ultrasound or nuclear magnetic resonance (NMR) signals.

A further object of the present invention is a reduction in the use of ecologically suspect organic solvents in the coating of such heat-sensitive recording materials.

Other objects and advantages of the present invention will appear from the further description.

According to the present invention a heat-sensitive recording material suited for use in direct thermal imaging is provided, said recording material comprising:

(i) a layer (1) containing uniformly distributed in a film-forming water-insoluble resin binder a substantially light-insensitive organic metal salt, preferably a silver salt, and (ii) a layer (2) in direct contact with said layer (1) or in thermal working relationship therewith through the intermediary of a spacer layer (3), characterized in that said layer (2) contains uniformly distributed in a film-forming water-soluble hydrophilic binder at least one organic reducing agent, that is capable of diffusing out of said layer (2) into said layer (1) on heating said recording material.

The present invention also provides a method for producing a heat-sensitive recording material, as defined above, characterized in that said layer (1) is coated from a non-aqueous medium and said layer (2) is coated from an aqueous medium.

The present invention further includes a recording process wherein a heat-sensitive recording material, as defined above, is image-wise heated.

In particular the present invention provides a thermographic recording method with improved continuous tone reproduction wherein a heat-sensitive recording material, as defined above, is image-wise heated by means of a thermal head containing a plurality of image-wise electrically energized heating elements.

By "thermal working relationship" is meant here that the reagents responsible for the image formation can come into reactive contact with each other by diffusion of at least one of the reagents under the influence of heat, e.g. by diffusion through said spacer layer.

The layer where in image-wise a metal image is formed on image-wise reducing the substantially light-insensitive metal salt is called furtheron the recording layer or imaging layer.

DETAILED DESCRIPTION OF THE INVENTION

Figure 1:
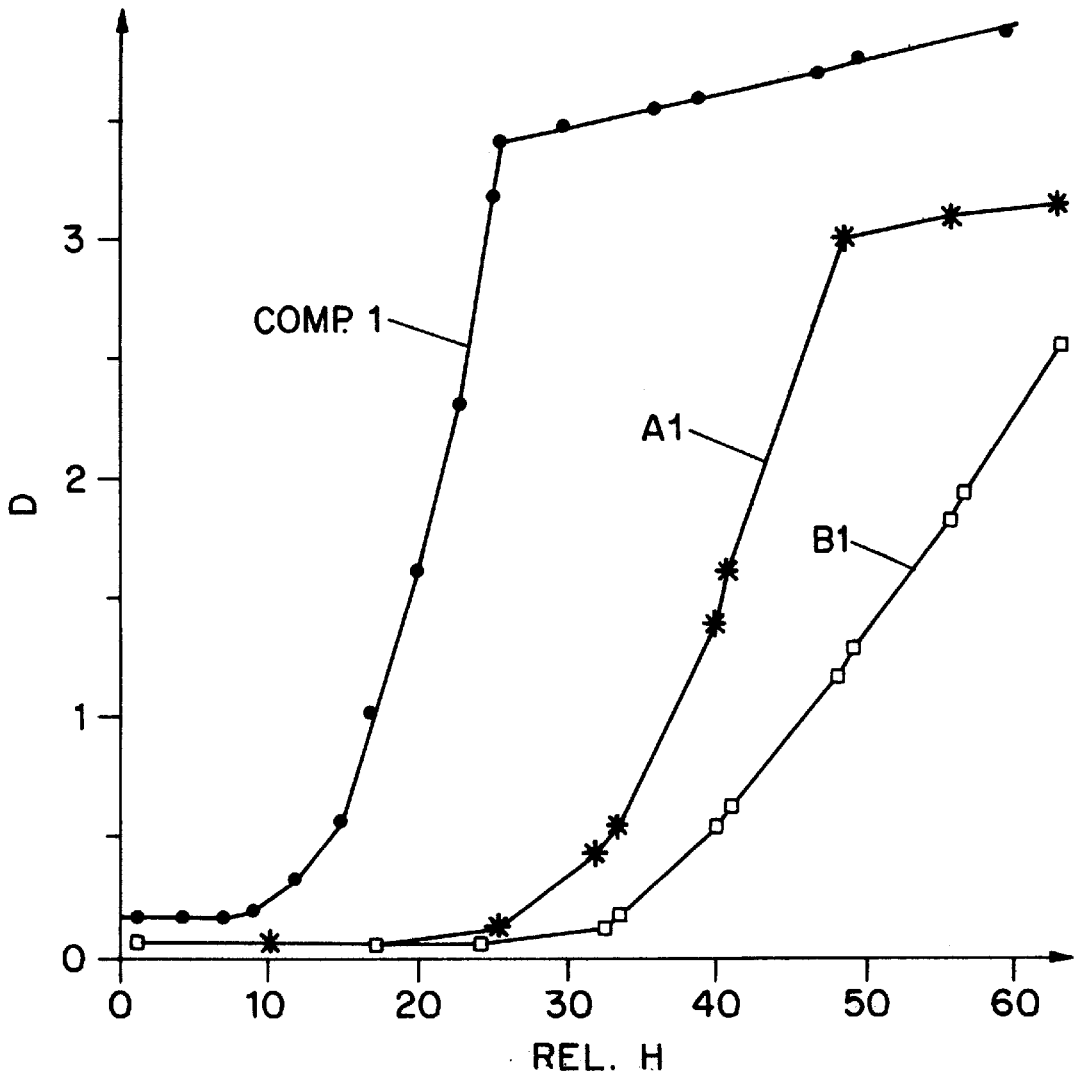
FIGS. 1, 2 and 3 represent characteristic sensitometric curves of prints obtained with heat-sensitive "non-invention" and "invention" recording materials. Said characteristic curves were obtained by plotting optical density (D) (logarithmic values) in the ordinate and linearly increasing amounts of exposure heat (relative values) (rel. H) in the abscissa.

The term "gradation" refers to the slope of a characteristic curve representing the relationship of optical density (D) plotted in the ordinate versus linearly increasing amounts of heat plotted in the abscissa, said different amounts of heat being applied to the thermographic material in neighbouring area analogously to the production of a stepwedge.

The linear increase of heat is obtained e.g. by linearly increasing the heating time at different areas of the recording material while keeping constant the heat input (J) per time unit (s). Alternatively the h eating time can be kept constant and the amount of input-heat is increased linearly.

By definition all gradients or slopes of said characteristic curve create together the gradation of the thermographic image. A gradient corresponds with the slope at a single point on the characteristic curve. The gamma (γ) is the maximum gradient of said characteristic curve, which is normally the gradient between the end of the toe and the beginning of the shoulder of the characteristic curve.

The heat-sensitive recording material according to the present invention yields a gradation which is much lower than can be obtained without using the above mentioned layer assemblage.

The speed of diffusion the organic reducing agents) out of the hydrophilic binder layer (2) is controlled by the intensity of the heating and the adsorption affinity of said agents to the hydrophilic binder giving rise to a larger amount of visually recognizable "grey-levels" in the imaging layer that contains the reducible substantially light-insensitive metal salt.

The coating of a relatively thick (dry coating thickness in the range of 2 to 20 μm) hydrophilic binder layer containing the diffusible reducing agent in a binder/reducing agent weight ratio in the range of 1/1 to 10/1 is particularly favourable for lowering the gradation.

The hydrophilic water-soluble binder of the layer containing the therein diffusible organic reducing agent may be any hydrophilic polymeric binder used in the preparation of photographic silver halide emulsion layers, preferably is a protein-type Finding agent such as gelatin, casein, collagen, albumin, or gelatin derivative, e.g. acetlyated gelatin. Further suitable water-soluble binding agents are: polyvinyl alcohol, dextran, gum arabic, zein, agar-agar, arrowroot, pectin, carboxymethyl cellulose, hydroxyethyl cellulose, poly(acrylic acid), and polyvinylpyrrolidone.

The optionally present spacer layer (3) is a thin (preferably 0.1 μm to 10 μm thick) polymeric layer allowing the passage by diffusion of said reducing agent(s).

The spacer layer (3) may be a hydrophilic polymeric layer, e.g. made of modified cellulose, e.g. cellulose diacetate, that has been coated free from reducing agent(s) or is a polymeric layer coated from a latex that on drying has some micro-pores allowing the passage of diffusing reducing agent(s). According to an other embodiment said spacer layer (3) contains a polymeric binder applied from an organic solvent which binder is permeable for the organic reducing agent(s) in molten state. When such spacer layer is present preference is given to the use of reducing agents the melting point of which is in the range of 60°to 120° C. (melting point of catechol=105° C.) or reducing agents are used that are characterized by sublimation, e.g. 2-bromo-1, 4-benzenediol (bromohydroquinone).

In said layer (2) the use of polyhydroxy-benzene reducing agents having at least two hydroxy groups in ortho- or para-position is preferred for obtaining continuous tone images. Examples of such reducing agents are catecol (pyrocatechol), hydroquinone, 2-methyl hydroquinone, 2-chloro-hydroquinone, 3-(3,4-dihydroxyphenyl) propionic acid, 1,2-dihydroxybenzoic acid, methyl gallate, ethyl gallate, propyl gallate and tannic acid. Another diffusible (very water-soluble) reducing agent is ascorbic acid belonging to the class of the reductones.

Diffusible reducing agents that are useful in the recording material of the present invention, and more particularly the polyhydroxy benzene reducing agents having at least two hydroxy groups in ortho or para position and melting point near 100° C., may be used in combination with other reducing agents operating as auxiliary reducing agents, e.g. sterically hindered phenols, that on heating become reactive partners in the reduction of the substantially light-insensitive silver salt such as silver behenate, or are used in combination with bisphenols as described in U.S. Pat. No. 3,547,648. The auxiliary reducing agents may be present in the imaging layer (1) and/or in the hydrophilic polymeric binder layer (2).

The film-forming water-insoluble resin binder of the recording layer containing the substantially light-insensitive organic metal salt is preferably a thermoplastic resin or mixture of such resins, wherein the silver salt can be dispersed homogeneously. For that purpose all kinds of natural, modified natural or synthetic water-insoluble resins may be used, e.g. cellulose derivatives such as ethylcellulose, cellulose esters, e.g. cellulose nitrate, polymers derived from α, β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters and polyethylene or mixtures thereof.

A particularly suitable polyvinyl butyral containing a minor amount of vinyl alcohol units is marketed under the trade name BUTVAR B79 of Monsanto USA and provides a good adherence to hydrophilic water-soluble polymeric layers.

The above mentioned polymers or mixtures thereof forming the water-insoluble binder may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347, 675. Further are mentioned compounds such as urea, methyl sulfonamide and ethylene carbonate being heat solvents described in U.S. Pat. No. 3,667,959, and compounds such as tetrahydrothiophene-1,1-dioxide, methyl anisate and 1,10-decanediol being described as heat solvents in Research Disclosure, December 1976, (item 15027) pages 26–28. Still other examples of heat solvents have been described in U.S. Pat. No. 3,438,776, and 4,740,446, and in published EP-A 0 119 615 and 0 122 512 and DE-A 3 339 810.

The layer containing the organic metal salt is commonly coated from an organic solvent containing the binder in dissolved form.

The binder to organic metal salt weight ratio is preferably in the range of 0.2 to 6, and the thickness of the recording layer is preferably in the range of 5 to 20 μm.

Substantially light-insensitive organic silver salts particularly suited for use in a heat-sensitive recording material according to the present invention are silver salts of aliphatic carboxlyic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps" Modified aliphatic carboxlyic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

The silver image density depends on the coverage of the above defined reducing agent(s) and organic silver salt(s) and has to be preferably such that, on heating above 100° C., an optimal density of at least 2.5 can be obtained.

Useful substantially light-insensitive organic metal salts other than silver salts are e.g. iron salts of an organic acid, e.g. the iron salts described in published European patent application 0 520 404, more particularly iron o-benzolybenzoate.

In order to obtain a neutral black image tone in the higher densities and neutral grey in the lower densities the recording layer contains preferably in admixture with said organic silver salts and reducing agents a so-called toning agent known from thermography or photo-thermography.

Suitable toning agents are the phthalimides and pnthalazinones within the scope of the general formulae described in U.S. Pat. No. 4,082,901. Further reference is made to the toning agents described in U.S. Pat. No. 3,074,809, 3,446,648 and 3,844,797. Other particularly useful toning agents are the heterocyclic toner compounds of the benzoxazine dione or naphthoxazine dione type within the scope of following general formula

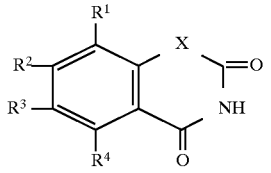

in which

X represents 0 or N-alkyl; each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. Toners within the scope of said general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

In addition to said ingredients the recording layer may contain other additives such as free fatty acids, surface-active agents, antistatic agents, e.g. non-ionic antistatic agents including a fluorocarbon group as e.g. in $F_3C(CF_2)_6CONH(CH_2CH_2O)$-H, silicone oil, e.g. BAYSILONE Ö1 A (tradename of BAYER AG—GERMANY), ultraviolet light absorbing compounds, white light reflecting and/or ultraviolet radiation reflecting pigments, colloidal silica, and/or optical brightening agents.

The support for the heat-sensitive recording material according to the present invention is preferably a thin flexible carrier made e.g. from paper, polyethylene coated paper or transparent resin film, e.g. made of a cellulose ester, e.g. cellulose triacetate, polyproplyene, polycarbonate or polyester, e.g. polyethylene terephthalate. The support may be in sheet, ribbon or web form and subbed if need be to improve the adherence to the thereon coated heat-sensitive recording layer.

The coating of the layers (1) and (2) may proceed by any coating technique e.g. as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Direct thermal imaging can be used for both the production of transparencies and reflection type prints. Such means that the support may be transparent or opaque, e.g. the support has a white light reflecting aspect. For example, a paper base is used which may contain white light reflecting pigments, optionally also applied in an interlayer between the recording layer and said base. In case a transparent base is used, said base may be colourless or coloured, e.g. has a blue colour.

In the hard copy field recording materials on white opaque base are used, whereas in the medical diagnostic field black-imaged transparencies find wide application in inspection techniques operating with a light box.

The recording materials of the present invention are particularly suited for use in thermographic recording techniques operating with thermal print-theads. Suitable thermal printing heads are e.g. a Fujitsu Thermal Head (FTP-040 MCS001), a TDK Thermal Head F415 HH7-1089, and a Rohm Thermal Head KE 2008-F3.

In a particular embodiment the hydrophilic binder layer (2) containing the reducing agent(s) is covered with the recording layer (1). Said embodiment is suited for use in by laser induced heat-recording wherein image-wise modulated laser light is directed through a transparent support and heats said layer (2) internally by absorption of the laser light therein. When using infrared laser light said layer (2) contains preferably infra-red light absorbing substances, examples of which are given in U.S. Pat. No. 4,912,083, 5,219,703 and 5,256,620.

In a special embodiment in order to avoid direct contact of the printheads with the hydrophilic polymeric binder layer (2) being outermost layer (not provided with a protective layer), the imagewise heating of the recording material with said printheads proceeds through a contacting but removable resin sheet or web wherefrom during said heating no transfer of imaging material can take place.

The layer (2) containing at least one reducing agent when being the outermost layer (the imaging layer may be the outermost layer) may contain hydrophilic finely divided (colloidal) optically transparent inert inorganic pigments such as transparent colloidal silica not masking the lateron formed silver image.

According to a special embodiment the recording material still being capable of obtaining an increase in optical density in the area that were not heated imagewise is stabilized against further density-increasing heat by removing the reductor source, viz. the layer (2) (in case it is a top layer). The removal of said layer may proceed by wash-off with an aqueous liquid, optionally while applying mild rubbing, or by stripping, e.g. using an adhesive sheet or web material firstly laminated to said layer and thereupon peeling apart (stripping off) therewith said layer (2) from the recording layer or spacer layer.

In an other embodiment in order to improve resistance against abrasion which may occur by frictional contact with the printheads, the layers (1) or (2) when being a top layer are coated with a protective coating or substances having anti-sticking properties through the presence of (a) lubricating agent(s). Thus, the outermost layer of the heat-sensitive recording material according to the present invention may comprise a dissolved lubricating material and/or a dispersed particulate lubricating material, e.g. talc particles, optionally protruding from the outermost layer. Examples of suitable lubricating materials are a surface active agent, a liquid lubricant, a solid lubricant or mixtures thereof.

The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid organic lubricants include various higher alcohols such as stearly alcohol, fatty acids and fatty acid esters.

As examples of outermost slipping layers are mentioned layers made from a styrene-acrylonitrile copolymer or a styrene-acrylonitrile-butadiene copolymer or binder mixture hereof containing as lubricant in an amount of 0.1 to 10 % by weight with respect to said binder(s) a polysiloxane-polyether copolymer or polytetrafluoroethylene or a mixture hereof.

Another suitable outermost slipping layer may be obtained by coating a solution of at least one silicon compound and a substance capable of forming during the coating procedure a polymer having an inorganic backbone which is an oxide of a group IVa or IVb element as described in published European patent application 0554576.

Other suitable protective layer compositions that may be applied as slipping (anti-stick) coating are described e.g. in published European patent applications (EP-A) 0 501 072 and 0 492 411.

The following comparative and invention examples illustrate the present invention. The percentages and ratios are by weight unless otherwise indicated.

COMPARATIVE EXAMPLE 1

A subbed polyethylene terephthalate support having a thickness of 175 μm was doctor blade-coated from a coating composition containing methyl ethyl ketone as a solvent and the following ingredients so as to obtain thereon after drying a layer containing per $m^2$:

| | |
|---|---|
| silver behenate | 4.42 g/$m^2$ |
| polyvinyl butyral (BUTVAR B79-tradename) | 4.42 g/$m^2$ |
| 3,4-dihydro-2,4-dioxo-1,3,2H-benzoxazine | 0.34 g/$m^2$ |

Onto said dried first layer a second layer was coated from a coating composition containing methyl ethyl ketone as a solvent and the following ingredients so as to obtain thereon after drying a layer containing per $m^2$:

| | |
|---|---|
| catechol | 2.5 g/$m^2$ |
| copolycarbonate PC3 as identified furtheron | 10.0 g/$m^2$ |
| TEGO-GLIDE 410 (trademark) as identified furtheron | 0.5 g/$m^2$ |

Copolycarbonate PC3 has the following structure:

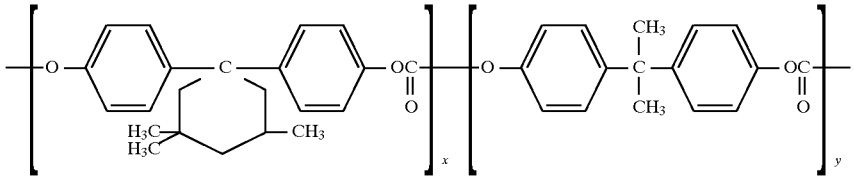

wherein x=55 mol % and y=45 mol %; having a viscosity ratio of 1.295.

The viscosity ratio is by definition the quotient of the viscosity of the polymer solution and of the pure solvent measured at the same temperature, here 20° C.

The synthesis of said copolymer is described in unpublished European patent application 93200653.9 filed Mar. 3, 1993.

TEGO-GLIDE 410 (trademark) is a lubricant of the polysiloxane/polyether type and commercially available from TEGO-CHEMIE.

COMPARATIVE EXAMPLE 2

Thermosensitive recording material A1

A subbed polyethylene terephthalate support having a thickness of 100 μm was doctor blade-coated from a coating composition containing methyl ethyl ketone as a solvent and the following ingredients so as to obtain thereon after drying a layer containing per $m^2$:

| | |
|---|---|
| silver behenate | 7.46 g/$m^2$ |
| polyvinyl butyral (BUTVAR B79-tradename) | 3.73 g/$m^2$ |
| 3,4-dihydro-2,4-dioxo-1,3,2H-benzoxazine | 0.85 g/$m^2$ |
| hydroquinone | 0.84 g/$m^2$ |

INVENTION EXAMPLE 1

Thermosensitive recording material B1

A subbed polyethylene terephthalate support having a thickness of 100 μm was doctor blade-coated from a coating composition containing methyl ethyl ketone as a solvent and the following ingredients so as to obtain thereon after drying a first layer containing per $m^2$:

| | |
|---|---|
| silver behenate | 7.46 g/$m^2$ |
| polyvinyl butytal (BUTVAR B79-tradename) | 3.73 g/$m^2$ |
| 3,4-dihydro-2,4-dioxo-1,3,2H-benzoxazine | 0.85 g/$m^2$ |

Onto said dried first layer a second layer was coated from aqueous medium so as to obtain thereon after drying a hydrophilic polymeric binder layer containing:

| | |
|---|---|
| hydroquinone | 0.84 g/m$^2$ |
| gelatin | 1.00 g/m$^2$ |

Thermographic printing

The heat-sensitive recording materials A1, B1 and that of comparative example 1 were exposed to a pattern of linearly increasing amounts of heat in a thermal head printer built for thermosensitometric purposes, using a separable polyethylene terephthalate ribbon of 6 $\mu$m thickness between the thermal print head and the outermost non-support layer of the heat-sensitive recording materials.

From the prints obtained in said materials A1, B1 and that of comparative example 1 characteristic sensitometric carves A1, B1 and Comp. 1 were plotted respectively in FIG. 1 with optical density (D) (logarithmic values) in the ordinate and linearly increasing amounts of heat (relative values) (rel. H) in the abscissa.

The optical density was measured in transmission with Macbeth TD 904 densitometer behind ortho-filter having its main transmission in the green part (500 nm to 600 nm) of the visible spectrum.

From the obtained curves can be learned that the slope of the linear part (between toe and shoulder) of the sensitometric curve in the cases of A1 and Comp. 1 of the non-invention materials A1 and comparative example 1 are particularly steep. The obtained density is high in both cases (more than 3).

The slope of the linear part (between toe and shoulder) of sensitometric curve B1 corresponding with the invention material B1 is considerably less steep than the slope of curve A1, and proves a soft gradation characteristic allowing the reproduction of at least 40 increasing grey values, whereas the non-invention material A1 may yield only 20 recognizable steps.

From the obtained sensitometric results it may be concluded that by coating from an aqueous medium a proper combination of hydrophilic binding agent (gelatin) and reducing agent in a hydrophilic binder layer adjacent to the imaging layer a soft gradation together with a high optical density can be obtained, whereas by coating from a non-aqueous medium a hydrophobic binding agent (PC3) and the same reducing agent in a hydrophobic layer adjacent to the imaging layer an undesirably hard gradation is obtained.

COMPARATIVE EXAMPLE 3

Thermosensitive recording material A2

A subbed polyethylene terephthalate support having a thickness of 100 $\mu$m was doctor blade-coated from a coating composition containing methyl ethyl ketone as a solvent and the following ingredients so as to obtain thereon after drying a layer containing per m$^2$:

| | |
|---|---|
| silver behenate | 7.46 g/m$^2$ |
| polyvinyl butyral (BUTVAR B79-tradename) | 3.73 g/m$^2$ |
| 3,4-dihydro-2,4-dioxo-1,3,2H-benzoxazine | 0.85 g/m$^2$ |
| catechol | 0.84 g/m$^2$ |

INVENTION EXAMPLE 2

Thermosensitive recording material B2

A subbed polyethylene terephthalate support having a thickness of 100 $\mu$m was doctor blade-coated from a coating composition containing methyl ethyl ketone as a solvent and the following ingredients so as to obtain thereon after drying a first layer containing per m$^2$:

| | |
|---|---|
| silver behenate | 7.46 g/m$^2$ |
| polyvinyl butyral (BUTVAR B79-tradename) | 3.73 g/m$^2$ |
| 3,4-dihydro-2,4-dioxo-1,3,2H-benzoxazine | 0.85 g/m$^2$ |

Onto said dried first layer a second layer was coated from aqueous medium so as to obtain thereon after drying a hydrophilic polymeric binder layer containing:

| | |
|---|---|
| catechol | 0.84 g/m$^2$ |
| gelatin | 2.10 g/m$^2$ |

INVENTION EXAMPLE 3

Thermosensitive recording material C2

The preparation of recording material C2 was the same as of recording material B2 with the difference however, that the coverage of catechol in the second layer was 1.26 g/m$^2$ and the coverage of gelatin 4.20 g/m$^2$.

INVENTION EXAMPLE 4

Thermosensitive recording material D2

The preparation of recording material D2 was the same as of recording material C2 with the difference however, that the coverage of gelatin in the second layer was doubled, viz. 8.40 g/m$^{2.}$ Thermographic printing The heat-sensitive recording materials A2, B2, C2 and D2 were exposed to a pattern of linearly increasing amounts of heat in a thermal head printer built for thermosensitometric purposes, using a separable polyethylene terephthalate ribbon of 6 $\mu$m thickness between the thermal print head and the outermost non-support layer of the heat-sensitive recording materials.

Figure 2:
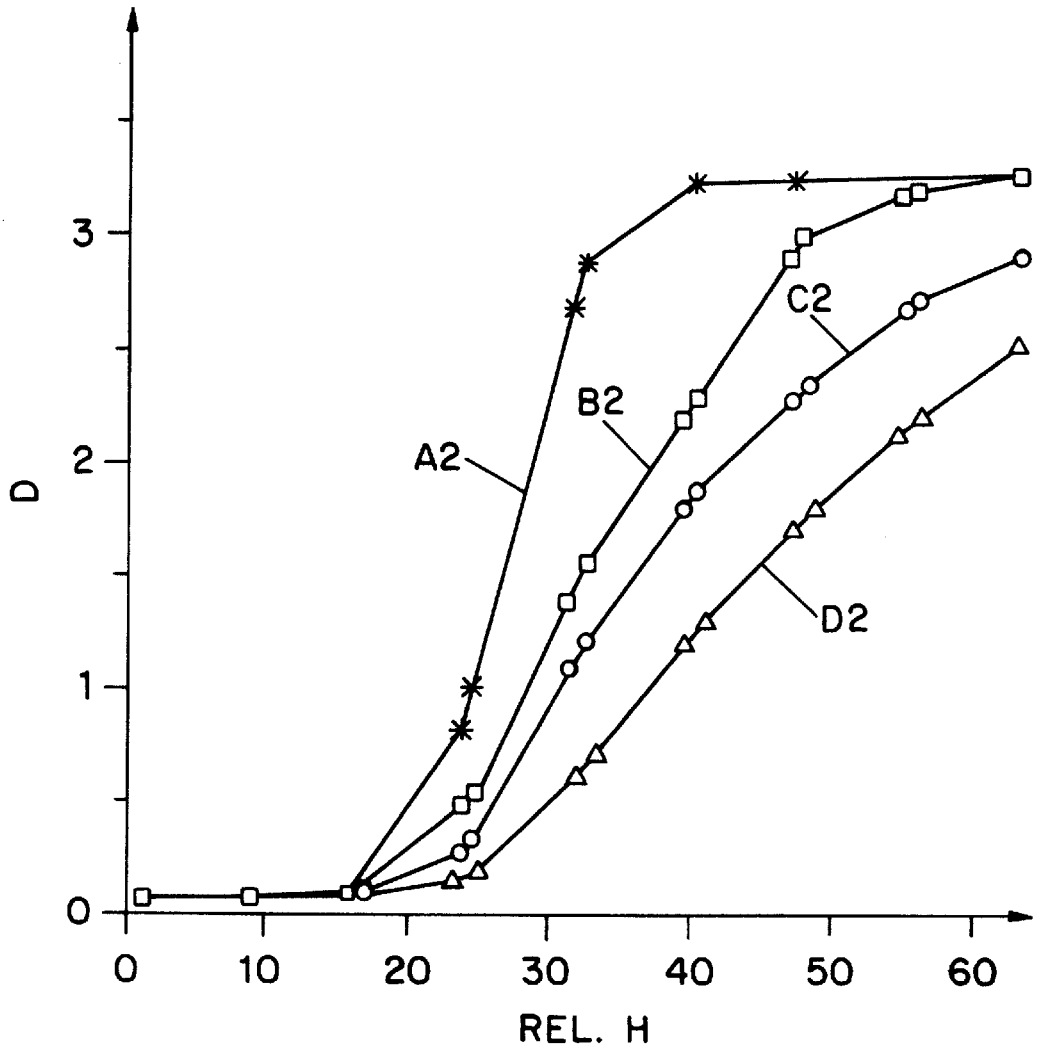

From the prints obtained in said materials A2, B2, C2 and D2 characteristic sensitometric curves A2, B2, C2 and D2 were plotted respectively in FIG. 2 with optical density (D) (logarithmic values) in the ordinate and linearly increasing amounts of heat (relative values) (rel. H) in the abscissa.

The optical density was measured in transmission wish Macbeth TD 904 densitometer behind ortho-filter having its main transmission in the green part (500 nm to 600 nm) of the visible spectrum.

From the obtained curves can be learned that the slope of the linear part (between toe and shoulder) of the sensitometric curve A2 of the non-invention material A2 is particularly steep. The density obtained is high (more than 3).

The slope of the linear part (between toe and shoulder) of sensitometric curves B2, C2 and D2 corresponding with the invention materials B2, C2 and D2 respectively is much less steep than the slope of curve A2. From the obtained sensitometric results it may be concluded that by coating from an aqueous medium a proper combination of hydrophilic binding agent (gelatin) and reducing agent in a hydrophilic binder layer adjacent to the imaging layer a soft gradation together with a high optical density can be obtained.

COMPARATIVE EXAMPLE 4

Thermosensitive recording material A3

A subbed polyethylene terephthalate support having a thickness of 100 $\mu$m was doctor blade-coated from a coating composition containing methyl ethyl ketone as a solvent and the following ingredients so as to obtain thereon after drying a layer containing per $m^2$:

| | |
|---|---|
| silver behenate | 7.46 $g/m^2$ |
| polyvinyl butyral (BUTVAR B79-tradename) | 3.73 $g/m^2$ |
| 3,4-dihydro-2,4-dioxo-1,3,2H-benzoxazine | 0.85 $g/m^2$ |
| catechol 0.84 $g/m^2$ | |

INVENTION EXAMPLE 5

Thermosensitive recording material B3

A subbed polyethylene terephthalate support having a thickness of 100 $\mu$m was doctor blade-coated from a coating composition containing methyl ethyl ketone as a solvent and the following ingredients so as to obtain thereon after drying a first layer containing per $m^2$:

| | |
|---|---|
| silver behenate | 7.46 $g/m^2$ |
| polyvinyl butyral (BUTVAR B79-tradename) | 3.73 $g/m^2$ |
| 3,4-dihydro-2,4-dioxo-1,3,2H-benzoxazine | 0.85 $g/m^2$ |

Onto said dried first layer a second layer was coated from aqueous medium so as to obtain thereon after drying a hydrophilic polymeric binder layer containing:

| | |
|---|---|
| hydroquinone | 0.84 $g/m^2$ |
| gelatin | 2.10 $g/m^2$ |

INVENTION EXAMPLE 6

Thermosensitive recording material C3

A subbed polyethylene terephthalate support having a thickness of 100 $\mu$m was doctor blade-coated from a coating composition containing methyl ethyl ketone as a solvent and the following ingredients so as to obtain thereon after drying a first layer containing per $m^2$:

| | |
|---|---|
| silver behenate | 7.46 $g/m^2$ |
| polyvinyl butyral (BUTVAR B79-tradename) | 3.73 $g/m^2$ |
| 3,4-dihydro-2,4-dioxo-1,3,2H-benzoxazine | 0.85 $g/m^2$ |

Onto said dried first layer a second layer serving as spacer layer was coated from methyl ethyl ketone so as to obtain thereon after drying a layer containing:

| | |
|---|---|
| copolycarbonate PC3 as identified above | 5.00 $g/m^2$ |

Onto said dried spacer layer a hydrophilic polymeric binder/reductor composition was coated from aqueous medium so as to obtain thereon after drying a hydrophilic polymeric binder layer containing:

| | |
|---|---|
| catechol | 0.84 $g/m^2$ |
| gelatin | 2.10 $g/m^2$ |

Thermographic printing

The heat-sensitive recording materials A3, B3 and C3 were exposed to a pattern of linearly increasing amounts of heat in a thermal head printer built for thermosensitometric purposes, using a separable polyethylene terephthalate ribbon of 6 $\mu$m thickness between the thermal print head and the outermost non-support layer of the heat-sensitive recording materials.

Figure 3:
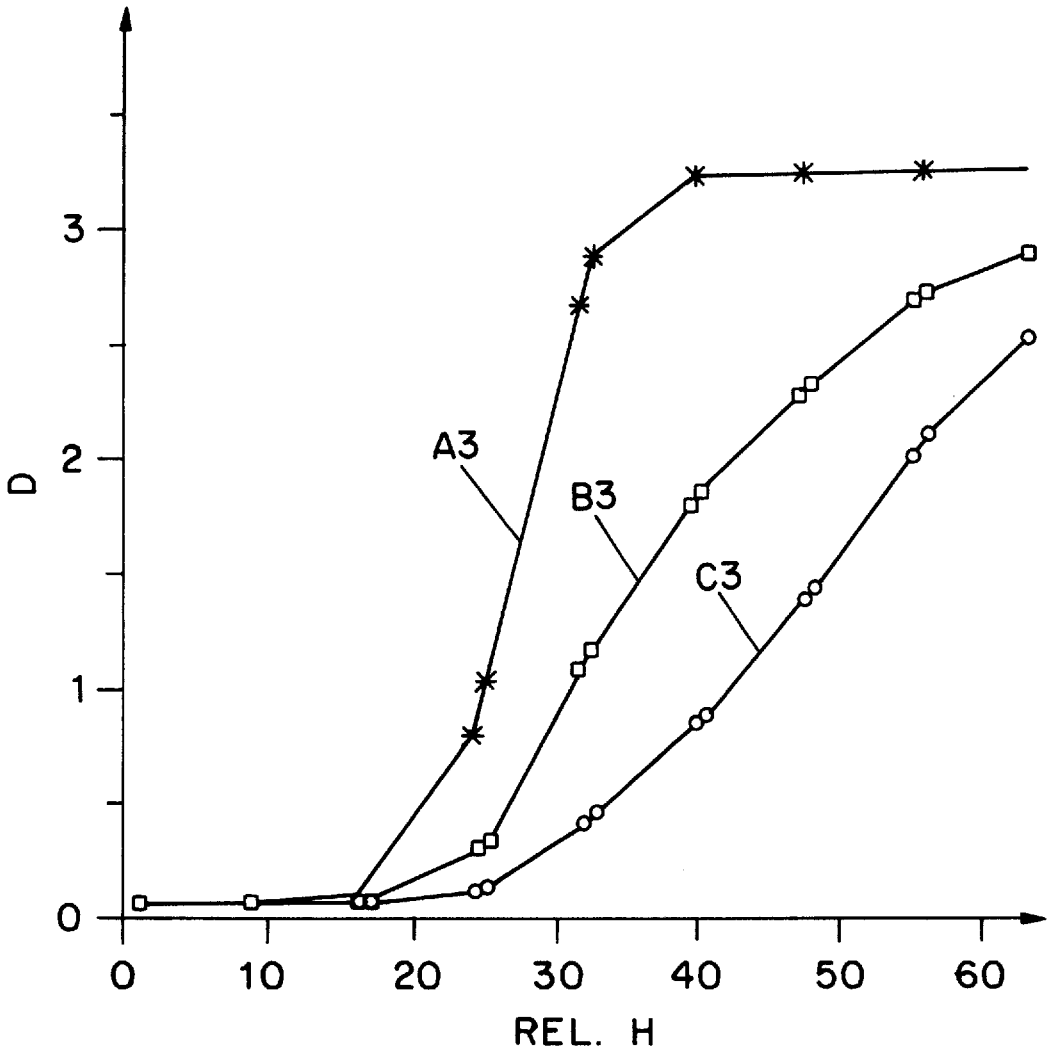

From the prints obtained in said materials A3, B3 and C3 characteristic sensitometric curves A3, B3 and C3 were plotted respectively in FIG. 3 with optical density (D) (logarithmic values) in the ordinate and linearly increasing amounts of heat (relative values) (rel. H) in the abscissa.

The optical density was measured in transmission with Macbeth TD 904 densitometer behind ortho-filter having its main transmission in the green part (500 nm to 600 nm) of the visible spectrum.

From the obtained curves can be learned that the slope of the linear part (between toe and shoulder) of the sensitometric curve A3 of the non-invention material A3 is particularly steel). The density obtained is high (more than 3).

The slope of the linear part (between toe and shoulder) of sensitometric curves 83 and C3 corresponding with the invention materials B3 and C3 respectively is considerably less steep than the slope of curve A3, and proves a soft gradation characteristic suited for continuous tone reproduction.

The C3 invention recording material allows the reproduction of at least 48 increasing grey values, whereas the non-invention material A3 may yield only 20 recognizable steps.

INVENTION EXAMPLE 7

Thermosensitive recording material A4

A subbed polyethylene terephthalate support having a thickness of 100 $\mu$m was doctor blade-coated from a coating composition containing methyl ethyl ketone as a solvent and the following ingredients so as to obtain thereon after drying a layer containing per $m^2$:

| | |
|---|---|
| silver behenate | 6.00 $g/m^2$ |
| polyvinyl butyral (BUTVAR B79-tradename) | 3.00 $g/m^2$ |
| 3,4-dihydro-2,4-dioxo-1,3,2H-benzoxazine | 0.22 $g/m^2$ |
| behenic acid | 0.60 $g/m^2$ |
| BAYSILONE Ö1 A (tradename) | 17 $mg/m^2$ |

Onto said dried first layer a second layer was coated from acetone so as to obtain thereon after drying a spacer layer containing:

| | |
|---|---|
| cellulose diacetate | 7.00 $g/m^2$ |

Onto said dried second layer a third layer was coated from water so as to obtain thereon after drying a layer containing

| | |
|---|---|
| catechol | 1.26 $g/m^2$ |
| gelatin | 4.20 $g/m^2$ |

Thermographic printing

The heat-sensitive recording material A4 was exposed to a pattern of linearly increasing amounts of heat in a thermal head printer built for thermosensitometric purposes, using a separable polyethylene terephthalate ribbon of 6 $\mu$m thickness between the thermal print head and the outermost non-support layer of the heat-sensitive recording material.

The optical density was measured in transmission with Macbeth TD 904 densitometer behind ortho-filter having its main transmission in the green part (500 nm to 600 nm) of the visible spectrum. The measured optical density was mo re than 3 in the stronger heat-exposed area. In the non-exposed area the optical density was 0.06.

After said measurement the two upper layers (second and third layer) of the recording material A4 were removed by stripping off using an adhesive tape. Hereupon the remaining material including the imaging layer (first layer) was overall heated at a temperature of 118° C. for 5 seconds.

The measurement of optical density was repeated and the recording material after said stripping off and overall heating possessed an optical density of 0.04 in the previously non-heated areas whereas the optical density remained practically the same in the previously image-wise heated areas.

We claim:

1. A recording process involving direct information-wise regulatable heating a recording material comprising:

(i) a layer (1) containing uniformly distributed in a film-forming water-insoluble resin binder a substantially light-insensitive organic metal salt, and (ii) a layer (2) in direct contact with said layer (1) or in thermal working relationship therewith through the intermediary of a spacer layer (3), said layer (2) containing uniformly distributed in a film-forming water-soluble hydrophilic binder at least one organic reducing agent, that is capable of diffusing out of said layer (2) into said layer (1) on heating said recording material and wherein said layer (2) contains said reducing agent or reducing agents in a binder/reducing agent weight ratio in the range of 1/1 to 10/1 and layer (1) or (2) is coated with an outermost protective layer having anti-sticking properties through the presence of a lubricating substance therein.

2. Recording process according to claim 1, wherein said layer (2) is removed after image-wise heating.

3. Recording process according to claim 2, wherein said layer (2) is removed by washing-off with an aqueous liquid or by delamination.

4. Recording process according to claim 1, wherein said heat-sensitive recording material is image-wise heated by means of a thermal head containing a plurality of image-wise electrically energized heating elements.

* * * * *